US005709570A

United States Patent [19]

Takayama

[11] Patent Number: 5,709,570

[45] Date of Patent: Jan. 20, 1998

[54] CABLE CONNECTING STRUCTURE

[75] Inventor: Katsumoto Takayama, Kawasaki, Japan

[73] Assignee: Fujitsu Limited, Kawasaki, Japan

[21] Appl. No.: 561,428

[22] Filed: Nov. 21, 1995

[30] Foreign Application Priority Data

Nov. 29, 1994 [JP] Japan ..... 6-294291

[51] Int. Cl.[6] ..... H01R 13/64

[52] U.S. Cl. ..... 439/681; 439/571

[58] Field of Search ..... 439/59, 61, 62, 439/76.1, 571, 633, 680, 681

[56] References Cited

U.S. PATENT DOCUMENTS

| | | | |
|---|---|---|---|
| 5,178,561 | 1/1993 | Lindeberg et al. | 439/571 |
| 5,273,463 | 12/1993 | Kaetsu et al. | 439/681 |
| 5,335,301 | 8/1994 | Newman et al. | 439/681 X |

FOREIGN PATENT DOCUMENTS

| | | | |
|---|---|---|---|
| 2806762 | 8/1979 | Germany | 439/618 |

*Primary Examiner*—Khiem Nguyen
*Attorney, Agent, or Firm*—Staas & Halsey

[57] ABSTRACT

A cable connecting structure includes a cable connector connected to a cable, a back panel selectively provided with one or a plurality of projections depending on a connecting position of the cable connector, and a substrate assembly having first and second ends and having a plurality of movable sliders extending between the first and second ends. Each of the sliders has third and fourth ends. The third end of at least one of the sliders makes contact with the projection of the back panel and the fourth end thereof projects from the first end of the substrate assembly when the second end of the substrate assembly connects to the back panel. The cable connector has at least one recess which receives and accommodates the fourth end of the at least one of the sliders when the cable connector connects to the first end of the substrate assembly.

9 Claims, 7 Drawing Sheets

FIG. 8

| NUMBER OF USED CONTACT PORTIONS / NUMBER OF PROJECTIONS | 0 | 1 | 2 | 3 | 4 | 5 | 6 | 7 | 8 |
|---|---|---|---|---|---|---|---|---|---|
| 1 | 1 | 1 | | | | | | | |
| 2 | 1 | 2 | 1 | | | | | | |
| 3 | 1 | 3 | 3 | 1 | | | | | |
| 4 | 1 | 4 | 6 | 4 | 1 | | | | |
| 5 | 1 | 5 | 10 | 10 | 5 | 1 | | | |
| 6 | 1 | 6 | 15 | 20 | 15 | 6 | 1 | | |
| 7 | 1 | 7 | 21 | 35 | 35 | 21 | 7 | 1 | |
| 8 | 1 | 8 | 28 | 56 | 70 | 56 | 28 | 8 | 1 |

CABLE CONNECTING STRUCTURE

BACKGROUND OF THE INVENTION

The present invention generally relates to cable connecting structures, and more particularly to a cable connecting structure for connecting a cable connector and a substrate assembly which is connected to a back panel, so that an erroneous connection of the cable connector is prevented.

FIGS. 1A and 1B respectively are perspective views for explaining an example of a conventional cable connecting structure. As shown in FIG. 1A, a key-pin 70*a* for preventing erroneous connection is provided on a front surface of each of substrates 70A and 70B to which cable connectors 71A and 71B shown in FIG. 1B connect. On the other hand, each of the cable connectors 71A and 71B shown in FIG. 1B is provided with a key-pin hole 71*a* which receives the key-pin 70*a* of the corresponding one of the substrates 70A and 70B. A cable 72 is connected to each of the cable connectors 71A and 71B. The cable connectors 71A and 71B are connected to the substrates 70A and 70B by fitting the cable connectors 71A and 71B over the key-pins 70*a* of the corresponding substrates 70A and 70B, so that the key-pin 70*a* fits into the key-pin hole 71*a* of the respective cable connectors 71A and 71B. The erroneous connection of the cable connector 71 and the substrate, such as an erroneous connection of a cable connector of a type different from that of the cable connectors 71A and 71B to the substrate 70A or 70B, is prevented by the corresponding shapes of the key-pin 70*a* and the key-pin hole 71*a* because the cable connector of the different type has a key-pin hole shaped differently from the key-pin hole 71*a*.

According to the conventional cable connecting structure described above, one type of key-pin and corresponding key-pin hole is normally used for one type of substrate and cable connector pair. However, even with respect to the substrates of the same type, the cable connectors must be connected according to a predetermined rule. In other words, only the cable connector 71A shown in FIG. 1B is permitted to connect to the substrate 70A shown in FIG. 1A, and only the cable connector 71B shown in FIG. 1B is permitted to connect to the substrate 70B shown in FIG. 1A.

If the substrates 70A and 70B are of the same type and the cable connectors 71A and 71B are of the same type, the two pairs are mechanically the same and it was possible to connect the cable connector 71B to the substrate 70A, but such a connection should not be permitted. Therefore, although the conventional cable connecting structure was capable of preventing the erroneous connection of different types of substrate and cable connector, it was impossible to prevent the erroneous connection of the same type of substrate and cable connector.

SUMMARY OF THE INVENTION

Accordingly, it is a general object of the present invention to provide a novel and useful cable connecting structure in which the problem described above is eliminated.

Another and more specific object of the present invention is to provide a cable connecting structure which connects a cable connector to a substrate assembly which is connected to a back panel, comprising a substrate assembly connecting to the back panel depending on a connecting position of the back panel, a transmitting part transmitting a relationship of the connecting position of the back panel and the substrate assembly to a surface of said transmitting part confronting the back panel, and a cable connector connected to the substrate assembly, wherein the substrate assembly and the cable connector are connected with a relationship which is determined by the relationship of the connecting position of the back panel and the substrate assembly that is transmitted by the transmitting part. This transmitting part may be realized by mechanical means as in the case of the above described embodiment or, by other means such as electrical means and optical means. According to the cable connecting structure of the present invention, it is possible to prevent erroneous connections among the same type of substrate assemblies and cable connectors, and the efficiency and accuracy of the cable connections can be improved.

Another object of the present invention is to provide a cable connecting structure comprising a cable connector connected to a cable, a back panel selectively provided with one or a plurality of projections depending on a connecting position of the cable connector, and a substrate assembly having first and second ends and having a plurality of movable sliders extending between the first and second ends, where each of the sliders has third and fourth ends, the third end of at least one of the sliders makes contact with the projection of the back panel and the fourth end thereof projects from the first end of the substrate assembly when the second end of the substrate assembly connects to the back panel, and the cable connector has at least one recess which receives and accommodates the fourth end of the at least one of the sliders when the cable connector connects to the first end of the substrate assembly. According to the cable connecting structure of the present invention, it is possible to prevent erroneous connections among the same type of substrate assemblies and cable connectors, and the efficiency and accuracy of the cable connections can be improved.

Still another object of the present invention is to provide a cable connector adapted to make electrical connections to a block having at least one projection, comprising a plurality of contact portions, and at least one recess provided at a position to receive and accommodate the projection of the block when the cable connector connects to the block, where the recess is provided in place of an unused one of the contact portions. According to the cable connector of the present invention, it is possible to realize efficient and accurate cable connections by use of a simple structure.

A further object of the present invention is to provide a cable connector adapted to make electrical connections to a block having at least one projection, comprising a plurality of contact portions, a plurality of slide pieces movable between a neutral position and a projecting position, and at least one recess provided at a position to receive and accommodate the projection of the block when the cable connector connects to the block, where the recess is formed by at least one of the slide pieces in the neutral position. According to the cable connector of the present invention, it is possible to realize efficient and accurate cable connections by use of a simple structure, and the connection patterns are easily selectable.

Another object of the present invention is to provide a substrate assembly adapted to make electrical connections to a back panel having at least one projection and to a cable connector, comprising a substrate having a part mounting surface, circuit elements mounted on the part mounting surface of the substrate, a first block provided on a first end of the substrate for making electrical connections to the back panel, and a second block provided on a second end of the substrate for making electrical connections to the cable connector, where a plurality of movable sliders extend between the first and second ends, each of the sliders has third and fourth ends, the third end of at least one of the sliders makes contact with the projection of the back panel and the fourth end thereof projects from the first end when the first block connects to the back panel, and the sliders extend between the first and second blocks in a non-utilized space above the substrate. According to the substrate assembly of the present invention, it is possible to realize efficient and accurate connections to the back panel and a cable connector.

Still another object of the present invention is to provide a substrate assembly adapted to make electrical connections to a mother board which has at least one projection, comprising a substrate having a part mounting surface, a first end and a second end, circuit elements mounted on the part mounting surface of the substrate, a first block provided on the first end of the substrate, and a second block provided on the second end of the substrate, where a plurality of movable sliders extend between the first and second ends, each of the sliders has third and fourth ends, the third end of at least one of the sliders makes contact with the projection of the mother board and the fourth end thereof projects from the first end when the first block connects to the mother board, and the sliders extend between the first and second blocks in a non-utilized space above the substrate. According to the substrate assembly of the present invention, it is possible to realize efficient and accurate connections to the mother board and a cable connector.

Other objects and further features of the present invention will be apparent from the following detailed description when read in conjunction with the accompanying drawings.

BRIEF DESCRIPTION OF THE DRAWINGS

FIG. 8 is a diagram showing various patterns for preventing erroneous connection.

DESCRIPTION OF THE PREFERRED EMBODIMENTS

Figure 1A:
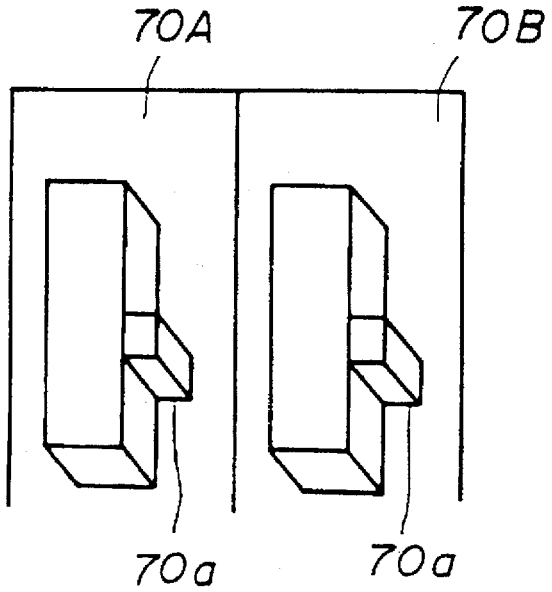
FIG. 1A PRIOR ART
FIGS. 1A and 1B respectively are perspective views for explaining an example of a conventional cable connecting structure.
Figure 1B:
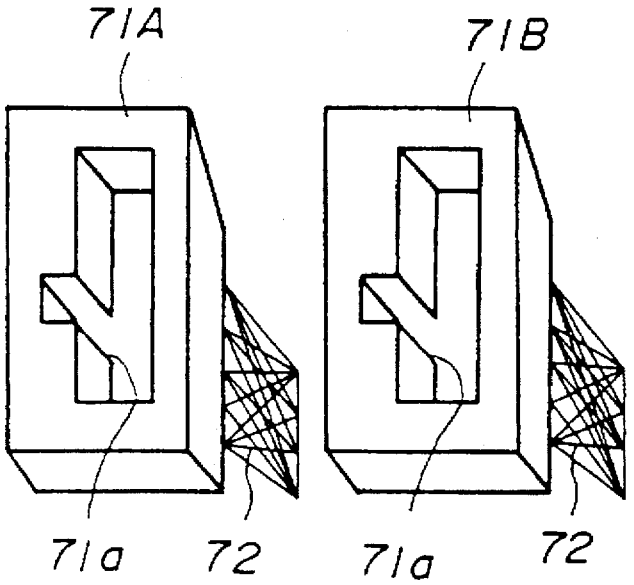
FIG. 1B PRIOR ART
Figure 2:
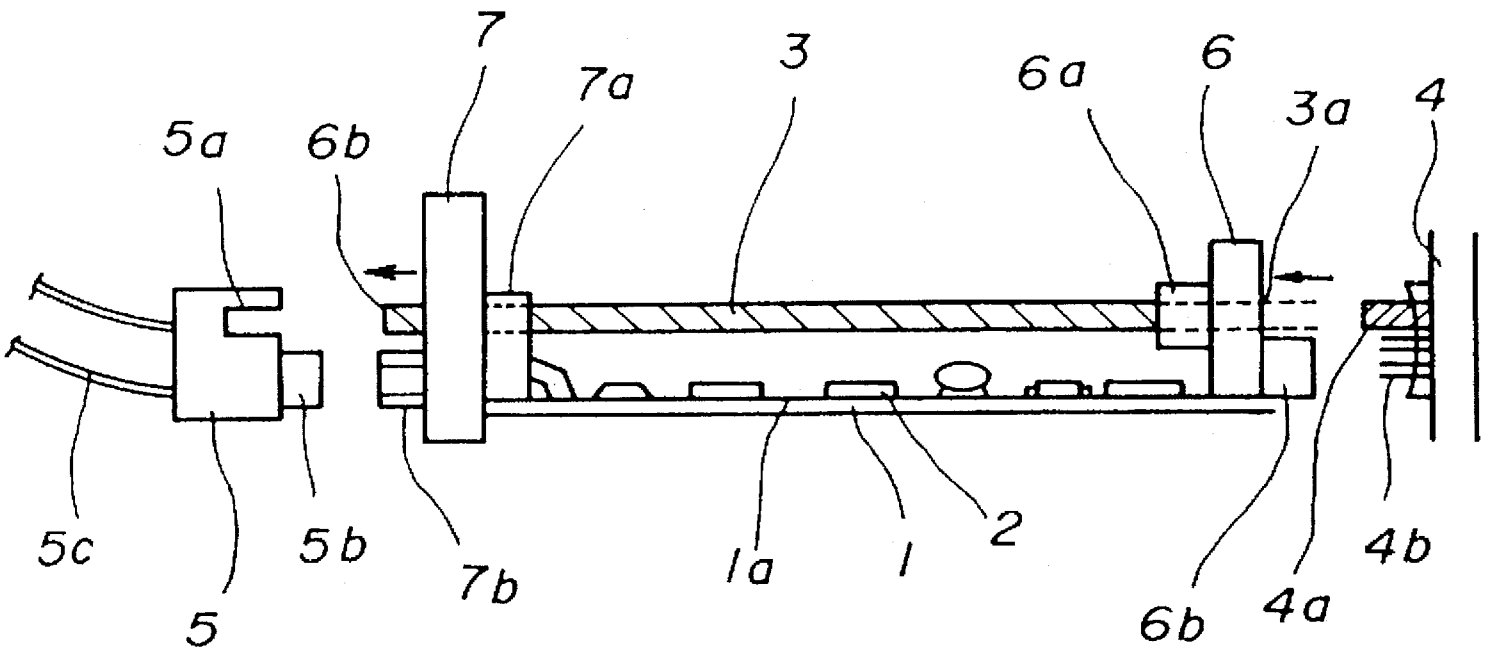
FIG. 2 is a cross sectional view showing an embodiment of a cable connecting structure according to the present invention.
Figure 3:
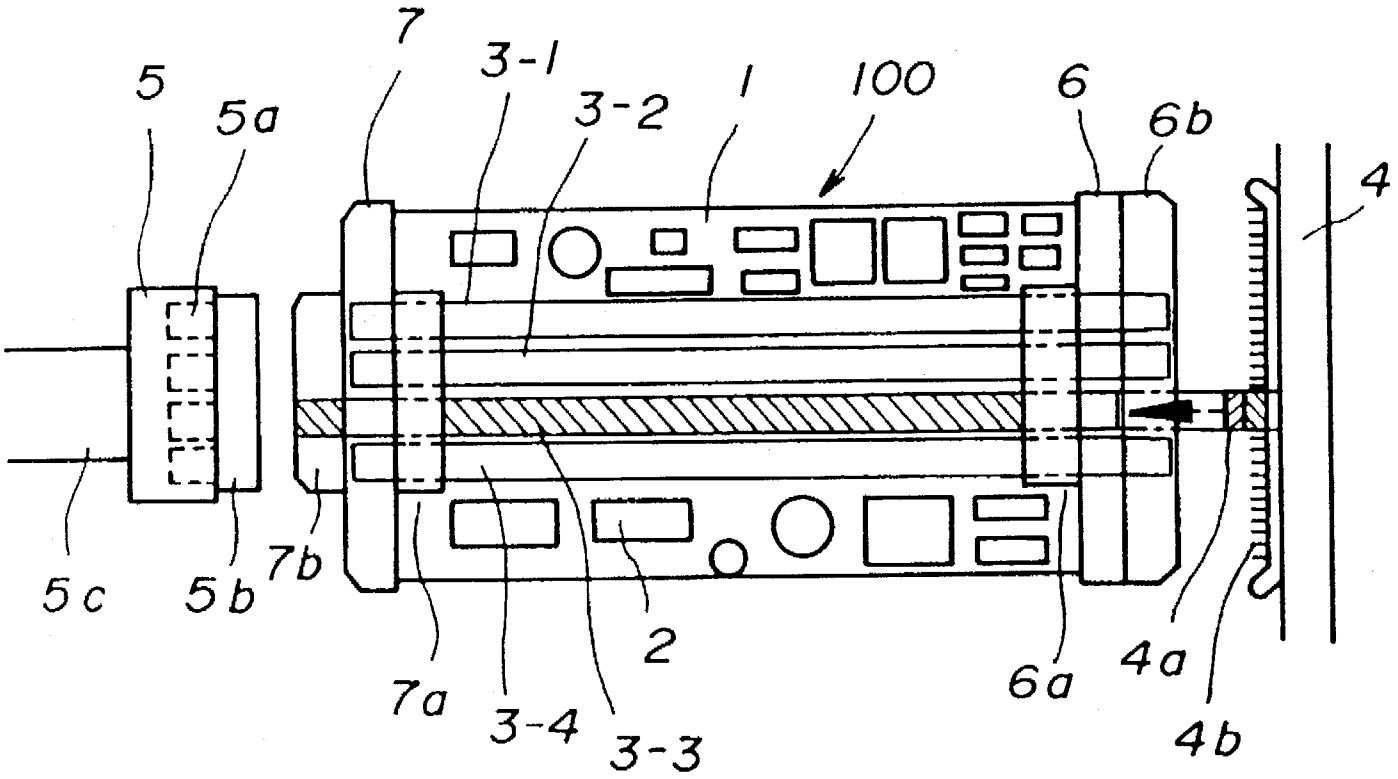
FIG. 3 is a top view showing the embodiment of the cable connecting structure.

FIG. 2 is a cross sectional view showing an embodiment of the cable connecting structure according to the present invention, and FIG. 3 is a top view showing the cable connecting structure shown in FIG. 2.

As shown in FIGS. 2 and 3, a substrate assembly 100 is mounted on a computer or the like using a shelf structure. The substrate assembly 100 is vertically connected to a back panel 4 which is positioned to the rear of the shelf structure. More particularly, a plurality of terminals **4*b* stand at a substrate connecting position of the back panel 4, and a connector 6*b* which projects from a rear end of the substrate assembly 100 with respect to the terminals 4*b* engages the terminals 4*b*** thereby making a connector connection.

A connector **7*b* projects from a tip end of the substrate assembly 100. A cable connector 5 has a contact portion 5*b*, and the contact portion 5*b* engages the connector 7*b*** thereby making a connector (electrical) connection.

A cable **5*c* is mounted on a rear end of the cable connector 5. Various signals, power supply voltage and the like are supplied to the back panel 4 via the cable 5*c*, so that the signals, power supply voltage and the like are supplied to other substrate assemblies from the back panel 4**.

A projection **4*a* projects from the surface of the back panel 4 on which the terminals 4*b* stand. The position of the projection 4*a* on the back panel 4 is selected depending on a mounting position of the cable connector 5. Since the projection 4*a* is selectively provided, this embodiment has four possible regions (hereinafter referred to as projection-providing regions) in which the projection 4*a* may be provided, however, the number of projection-providing regions is of course not limited to four. In this embodiment, the projection 4*a* is provided in at least one of the four projection-providing regions, and a plurality of combinations of the positions of the projections 4*a* exist. Further, the position or positions where the projection 4*a* is provided, that is, the arrangement pattern of the projections 4*a*, is selected depending on the connecting position of the cable connector 5**.

Various integrated circuits such as large scale integrated circuits (LSIs), and parts 2 such as resistors and capacitors are mounted on a part mounting surface **1*a* of a substrate 1. With respect to the part mounting surface 1*a*, a back block 6 is provided on the rear end of the substrate 1 and a front block 7 is provided on the tip end of the substrate 1. The connector 6*b* which connects to the back panel 4 is provided on the back block 6. On the other hand, the connector 7*b* which connects to the cable connector 5 is provided on the front block 7**.

A plurality of movable rods (hereinafter referred to as sliders) 3 are provided to transmit a specific connecting position of the cable connector 5. The sliders 3 have a length such that the sliders 3 extend between the back block 6 and the front block 7, and the sliders 3 at least penetrate the back block 6 and the front block 7. The sliders 3 are arranged in a horizontal direction as shown in FIG. 3, and four slides 3-1 through 3-4 are provided in this embodiment. For example, the sliders 3 are made of a material such as plastic.

As shown in FIGS. 2 and 3, a support member **7*a* is provided on the front block 7 by screws 101 (only shown in FIG. 4) or the like to improve the connection strength. Similarly, a support member 6*a* is provided on the back block 6 by screws 102 (only shown in FIG. 5**) or the like to improve the connection strength.

Figure 4:
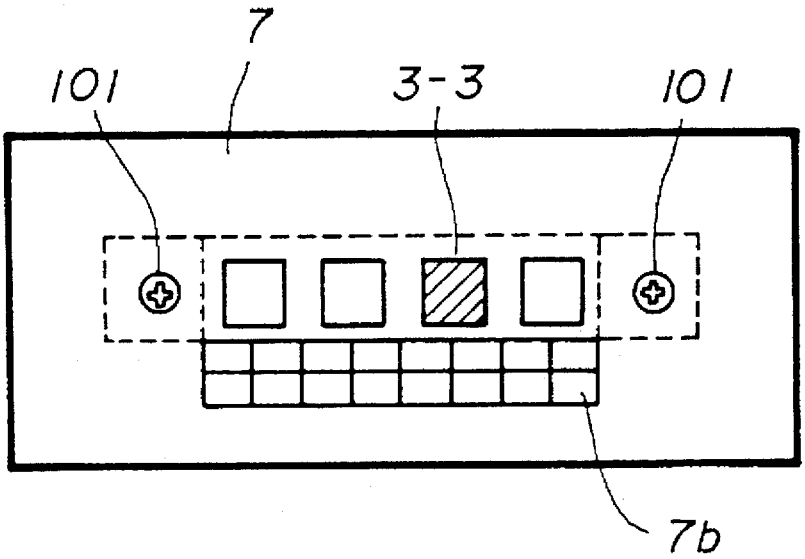
FIG. 4 is a front view showing a front face of a front block.

FIG. 4 is a front view showing a front face of the front block 7, where the screws 101 fix the support member **7*a* on the front block 7. The connector 7*b* is exposed at the front face of the front block 7**.

Figure 5:
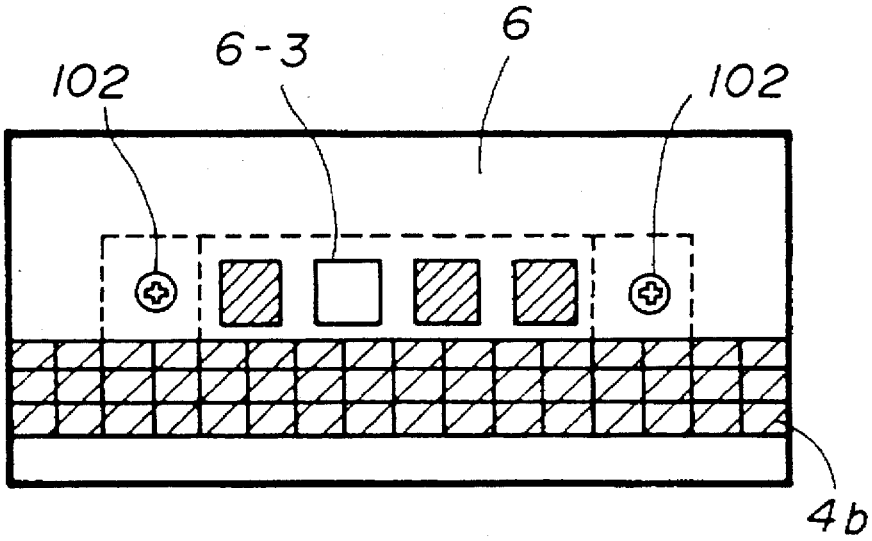
FIG. 5 is a rear view showing a back face of a back block.

FIG. 5 is a rear view showing a back face of the back block 6, where the screws 102 fix the support member **6*a* on the back block 6. The terminals 6*b* are exposed at the back face of the back block 6**.

The sliders 3 are provided in a non-utilized space (or dead space) on the substrate 1. Accordingly, the provision of the sliders 3 will not unnecessarily increase the height of the substrate assembly 100 taken in a vertical direction in FIG. 2.

When the substrate assembly 100 is connected to the back panel 4 to make a connector connection, one of the sliders 3-1 through 3-4 is pushed depending on the position of the projection 4a which is provided on the back panel 4. In this embodiment, a rear end of the slider 3-3 makes contact with the projection 4a which is provided at a position of the back panel 4 corresponding to the slider 3-3. Hence, only the slider 3-3 moves to the left in FIG. 3 while the other sliders 3-1, 3-2 and 3-4 remain stationary as they are. When the slider 3-3 moves to the left in FIG. 3, a tip end of the slider 3-3 penetrates the front block 7 and projects from the front block 7.

The cable connector 5 has one or a plurality of recesses 5a which can receive and accommodate the projecting tip ends of the sliders 3. The recesses 5a are provided at positions confronting the projections 4a provided on the back panel 4. In this embodiment, the cable connector 5 has one recess 5a which is provided at a position confronting the projection 4a provided on the back panel 4, and this recess 5a can receive and accommodate the projecting tip end of the slider 3-3.

According to this embodiment, the recess 5a is selectively provided depending on the connecting position of the cable connector 5. For this reason, it is possible prevent erroneous connector connections among the same type of substrate assemblies and cable connectors.

In the embodiment described above, the recess provided in the cable connector is provided independently of the contact portion 5b. However, the cable connector in most cases are provided with a plurality of contact portions, and in some cases, the cable connector is provided with a plurality of columns of contact portions. On the other hand, it is very rare that all of the contact portions of the cable connector are used. In other words, one or more unused contact portions usually exist among the plurality of contact portions provided in the cable connector. Hence, instead of providing a recess exclusively for receiving and accommodating the tip end of the slider, it is possible to effectively utilize the unused contact portion by providing the recess in place of the unused contact portion, thereby making it unnecessary to provide a special space for accommodating the slider and to realize a thin cable connector.

Figure 6:
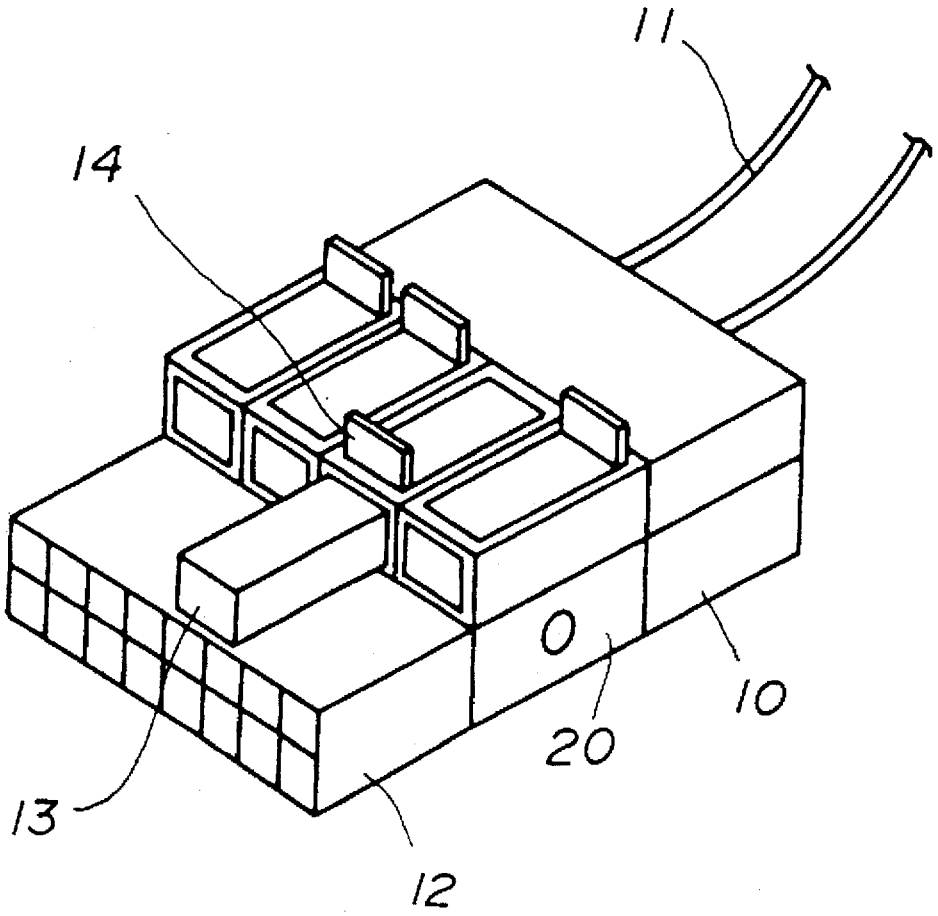
FIG. 6 is a perspective view showing a cable connector of a modification of the embodiment of the cable connecting structure.

Next, a description will be given of a modification of the embodiment of the cable connecting structure according to the present invention, by referring to FIG. 6. FIG. 6 is a perspective view showing a cable connector of this modification.

In a cable connector 10 shown in FIG. 6, slide pieces 13 are movably provided above contacts 12. Each slide piece 13 is connected to a manipulating part (or tab) 14, and each slide piece 13 can be made to project on the side of the contacts 12 by manually sliding the manipulating part 14. A mounting part 20 positions the slide pieces 13 with respect to the cable connector 10. The cable connector 10 is connected to a cable 11. For example, the slide pieces 13 are made of a material such as plastic.

Figure 7A:
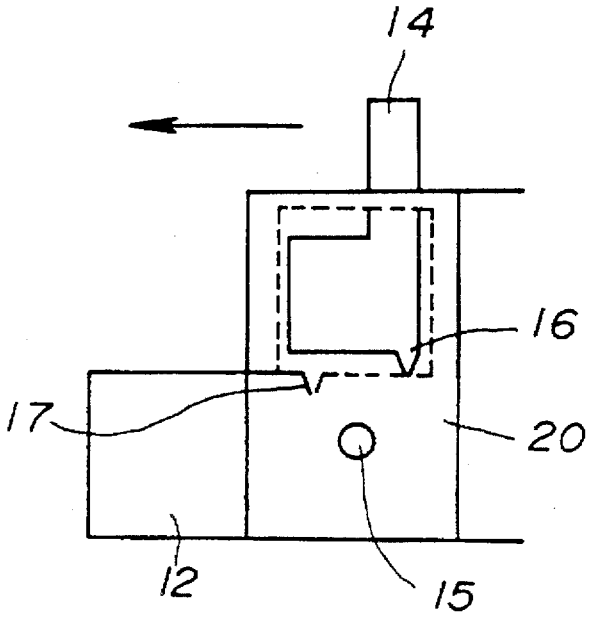
FIGS. 7A and 7B respectively are cross sectional views showing a locking mechanism of the cable connector shown in FIG. 6 in an unlocked state and a locked state.
Figure 7B:
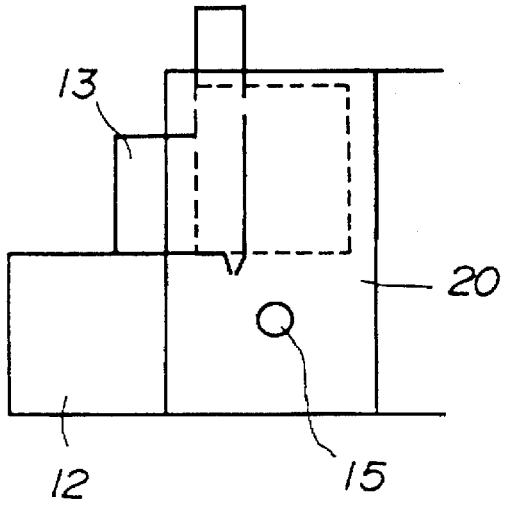

FIGS. 7A and 7B respectively are cross sectional views showing a locking mechanism of the cable connector 10 shown in FIG. 6 in an unlocked state and a locked state. As shown in FIGS. 7A and 7B, a claw 16 is provided on a bottom portion of the slide piece 13 which is movable by the manipulating part 14. On the other hand, a groove 17 is provided on the cable connector 10, so that the claw 16 engages the groove 17 when moved from an unlocked position shown in FIG. 7A to a locked position shown in FIG. 7B.

When the manipulating part 14 is manipulated to move the slide piece 13 in a direction of an arrow in FIG. 7A, the slide piece 13 moves to the left from a neutral position to a projecting position. In the projecting position, the claw 16 engages the groove 17 so that the position of the slide piece 13 is restricted in the horizontal direction. In other words, the slide piece 13 is locked when the claw 16 engages the groove 17. The mounting part 20 which positions the slide pieces 13 is mounted on the cable connector 10 at supporting points 15. For example, the mounting part 20 is supported by screws at the supporting points 15.

According to this modification, the slide pieces 13 are provided with respect to the cable connector 10, and the positions of the slide pieces 13 are determined depending on the positions of the sliders 3, so as to correspond to the connecting position of the cable connector 10. More particularly, the slide piece 13 is made to project at a position other than the position where the slider 3 projects and not to project at a position where the slider 3 projects, to thereby form a receiving and accommodating portion (or recess) for each projecting slider 3.

If the same slider 3-3 projects as in the case of the embodiment described above, the rightmost slide piece 13 and the leftmost slide piece 13 are made to project in addition to the projecting slide piece 13 shown in FIG. 6.

FIG. 8 is a diagram showing various patterns for preventing erroneous connection when a plurality of projections 4a project from the back panel 4 (or mother board) and a plurality of unused contact portions 5b can be utilized as the recesses 5a. FIG. 8 shows the patterns for a case where a maximum number of projections 4a is 8, and a maximum number of used contact portions 5b is 8. In FIG. 8, the number within each hatched portion indicates the maximum number of kinds of patterns with respect to the number of projections 4a.

In the embodiment described above, the positional relationship of the substrate assembly and the back panel, and the positional relationship of the substrate assembly and the cable connector are respectively determined mechanically. However, these positional relationships may of course be determined electrically, optically or by other appropriate means.

In other words, in a cable connecting structure which connects a cable connector to a substrate assembly which is connected to a back panel, the cable connecting structure may comprise a substrate assembly connecting to the back panel depending on a connecting position of the back panel, a transmitting part transmitting a relationship of the connecting position of the back panel and the substrate assembly to a surface of said transmitting part confronting the back panel, and a cable connector connected to the substrate assembly, wherein the substrate assembly and the cable connector are connected with a relationship which is determined by the relationship of the connecting position of the back panel and the substrate assembly that is transmitted by the transmitting part. This transmitting part may be realized by mechanical means as in the case of the above described embodiment or, by other means such as electrical means and optical means. The effects of such a cable connecting structure are basically the same as those of the above described embodiment.

Further, the present invention is not limited to these embodiments, but various variations and modifications may be made without departing from the scope of the present invention.

What is claimed is:

1. A cable connecting structure comprising:

a cable connector connected to a cable;

a panel selectively provided with at least one projection depending on a connecting position of said cable connector; and a substrate assembly having first and second ends and having a plurality of movable sliders extending between the first and second ends, each of said sliders having third and fourth ends, the third end of at least one of the sliders making contact with the projection of said panel and the fourth end thereof projecting from the first end of said substrate assembly when the second end of said substrate assembly connects to back panel, said cable connector including:

at least one recess which receives and accommodates the fourth end of said at least one slider when said cable connector connects to the first end of said substrate assembly; and a plurality of slide pieces which are movable between a neutral position and a projecting position, the position of said slide pieces depending on said at least one of the sliders projecting from the first end of said substrate assembly when the second end of said substrate assembly connects to said panel.

2. The cable connecting structure as claimed in claim 1, wherein said cable connector comprises a plurality of contact portions which make electrical connections to the first end of said substrate assembly, and said at least one recess is formed by an unused one of the contact portions.

3. The cable connecting structure as claimed in claim 1, wherein said cable connector further comprises:

manipulating parts respectively connected to the slide pieces and manipulated when moving the slide pieces; and a locking mechanism which locks each of the slide pieces in the projecting position.

4. The cable connecting structure as claimed in claim 1, wherein said substrate assembly comprises:

a substrate having a part mounting surface;

circuit elements mounted on the part mounting surface of the substrate;

a first block provided on the first end of said substrate assembly and connected to said substrate for making electrical connections to said back panel; and a second block provided on the second end of said substrate assembly and connected to said substrate for making electrical connections to said cable connector, said sliders extending between said first and second blocks in a non-utilized space above said substrate.

5. A cable connector adapted to make electrical connections to a block having at least one projection, said cable connector comprising:

a plurality of contact portions;

a plurality of slide pieces movable between a neutral position and a projecting position;

at least one recess provided at a position to receive and accommodate the projection of the block when said cable connector connects to the block; and a locking mechanism to lock each of said slide pieces in the projecting position, said recess being formed by at least one of said slide pieces in the neutral position.

6. A cable connecting structure comprising:

a cable connector connected to a cable;

a substrate assembly having first and second ends and having a plurality of movable sliders extending therebetween, said cable connector including:

at least one recess that receives and accommodates one end of at least one slider when said cable connector connects to the first end of said substrate assembly; and a plurality of slide pieces that are movable between a neutral position and a projecting position, the position of said slide pieces depending on said at least one slider projecting from the first end of said substrate assembly.

7. A cable connecting structure as claimed in claim 6, wherein said slide pieces include a locking mechanism to lock said slide pieces in the projecting position.

8. A cable connecting structure as claimed in claim 6, further comprising:

a panel selectively provided with at least one projection depending on a connecting position of said cable connector.

9. A cable connector as claimed in claim 8, wherein one end of at least one of said sliders makes contact with the projection of the panel, and the other end of said at least one slider projects from the first end of said substrate assembly when the second end of said substrate assembly connects to said panel.

* * * * *